United States Patent [19]

Semplak

[11] 4,282,530

[45] Aug. 4, 1981

[54] CYLINDRICAL PARABOLOID WEATHER COVER FOR A HORN REFLECTOR ANTENNA WITH WAVE ABSORBING MEANS

[75] Inventor: Ralph A. Semplak, Shrewsbury, N.J.

[73] Assignee: Bell Telephone Laboratories, Incorporated, Murray Hill, N.J.

[21] Appl. No.: 106,466

[22] Filed: Dec. 26, 1979

[51] Int. Cl.[3] ..... H01Q 13/00

[52] U.S. Cl. ..... 343/784; 343/18 A; 343/872

[58] Field of Search ..... 343/18 A, 18 R, 840, 343/872, 873, 915, 784

[56] References Cited

U.S. PATENT DOCUMENTS

| | | | |
|---|---|---|---|
| 3,156,917 | 11/1964 | Parmeggiani | 343/18 A |
| 3,351,947 | 11/1967 | Hart | 343/840 |
| 3,740,755 | 6/1973 | Grenzeback | 343/840 |
| 4,086,591 | 4/1978 | Siwiak et al. | 343/784 |

OTHER PUBLICATIONS

Moeschlin, L. "Computer Analysis of Radomes," Twelfth Symposium on Electromagnetic Windows, Atlanta, Ga., Jun. 12–14, pp. 8–11.

James, J. R., et al., "Gain Enhancement of Microwave Antennas," Proceedings of the IEE, vol. 122, No. 12, Dec. 75, pp. 1353–1358.

*Primary Examiner*—David K. Moore

*Attorney, Agent, or Firm*—Erwin W. Pfeifle

[57] ABSTRACT

The present invention relates to a method for reducing the weather cover-induced reflection sidelobes associated with horn reflector antenna arrangements. More particularly, the present invention consists of attaching the weather cover (26) to curved forms (21,23) placed in the antenna aperture, where the forms are shaped to contour the weather cover into a cylindrical paraboloid form, this form being capable of focusing the reflections from the weather cover onto a line inside the antenna arrangement. By covering this line inside the antenna with microwave absorbing material, (36) the focused weather cover reflections may be absorbed, thereby significantly reducing the sidelobes caused by the presence of the weather cover.

4 Claims, 6 Drawing Figures

CYLINDRICAL PARABOLOID WEATHER COVER FOR A HORN REFLECTOR ANTENNA WITH WAVE ABSORBING MEANS

BACKGROUND OF THE INVENTION

1. Technical Field

This invention relates to a cylindrical paraboloid weather cover for a horn reflector antenna, and more particularly, to contouring the weather cover in such a manner so that microwave reflections from the weather cover are focused onto a microwave absorber-covered linear section inside the antenna, thereby reducing the sidelobes generated by weather cover reflections.

2. Description of the Prior Art

In the past, to prevent the entry of rain, snow, and other various foreign bodies into the aperture of a horn reflector antenna and hence flowing down the waveguide transmission line, the aperture was covered by a flat piece of glass fiber fabric. The application of the weather cover was highly successful in excluding the elements, however, the reflections from the flat weather cover contributed to the sidelobe problem of horn reflector antennas. Parabolic designs have been considered, but only in conjunction with microwave dish antenna configurations, in which weather covers are referred to as radomes.

One example of this parabolic design is disclosed in U.S. Pat. No. 3,740,755 issued to R. J. Grenzeback on June 19, 1973. In this case, the antenna arrangement comprises a parabolic reflector with a confocal parabolic radome. The coincident foci of the reflector and radome causes reflections from the latter to be incident upon the reflector in the same direction as the energy directly incident thereon from the feed.

The use of a dielectric or microwave absorbing material in conjunction with radomes is also well-known in the prior art, and is discussed in the article "Gain Enhancement of Microwave Antennas by Dielectric-Filled Radomes" by J. R. James, et al in *Proceedings of the IEE,* Vol. 122, No. 12, December 1975 at pages 1353–1358. This article relates the performance of a microwave antenna which comprises a radome packed with dielectric material. Originally, the radome was packed to strengthen its aerodynamic profile. Using a simplified model based on rectangular geometry, it can be shown that such packing actually increases the gain of the antenna system.

The problem remaining in the prior art is to provide a method for suppressing the reflection sidelobes attributed to the use of weather covers in conjunction with horn reflector antennas.

SUMMARY OF THE INVENTION

The problem remaining in the prior art has been solved in accordance with the present invention, which relates to a cylindrical paraboloid weather cover for a horn reflector antenna, and more particularly, to contouring the weather cover in such a manner so that microwave reflections from the weather cover are focused onto a microwave absorber-covered linear section inside the antenna, thereby reducing the sidelobes generated by weather cover reflections.

It is an aspect of this invention to provide reduction of weather cover reflection-induced sidelobes of horn reflector antennas without forfeiting the benefits associated with using a weather cover. By attaching appropriately curved forms to the inner sidewalls of the horn, the weather cover may be fastened thereto to achieve the desired paraboloidal shape for focusing weather cover reflections onto the junction of the reflector and the horn. Microwave absorbing material disposed along this intersection of the paraboloidal reflector and the rear wall of the horn will absorb the weather cover reflections, thereby significantly reducing the sidelobes attributed to the implementation of the weather cover.

Other and further aspects of the present invention will become apparent during the course of the following description and by reference to the accompanying drawings.

BRIEF DESCRIPTION OF THE DRAWINGS

Referring now to the drawings, in which like numerals represent like parts in several views.

DETAILED DESCRIPTION

A rectangular horn reflector antenna is used in the description which follows and the accompanying drawings for illustrative purposes only. It will be understood that such description is exemplary only and is for purposes of exposition and not for purposes of limitation since the present invention is applicable to any suitable horn reflector antenna, one example of which is a conical horn reflector antenna.

Figure 1:
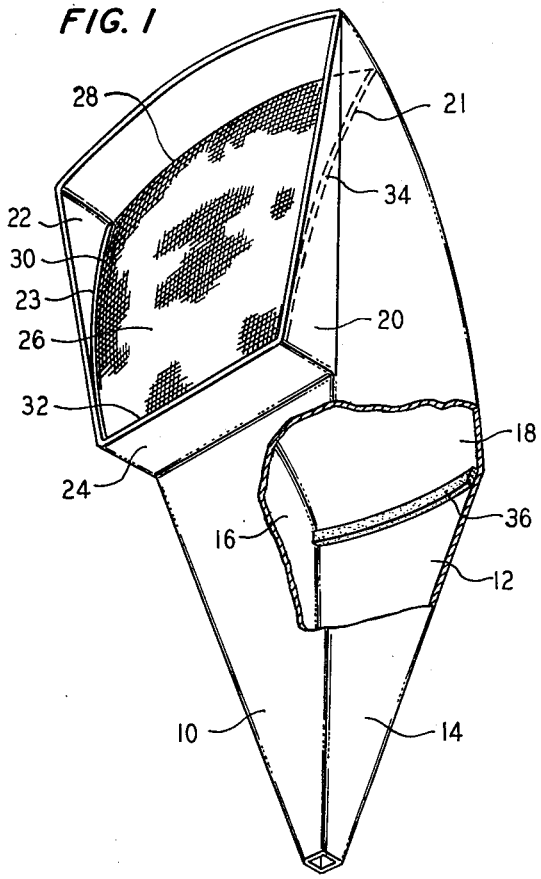
FIG. 1 is a partial cut-away in perspective of a rectangular horn reflector antenna including a weather cover formed in accordance with the present invention.

An exemplary rectangular horn reflector antenna formed in accordance with the present invention is shown in FIG. 1 with a portion of the horn removed to show clearly the arrangement of the absorbing material and cylindrical paraboloid weather cover. The rectangular horn comprises a front wall 10, back wall 12, and two sidewalls 14 and 16. Sidewalls 14 and 16 serve to join the corresponding edges of the front and back walls 10 and 12, and extend upwardly beyond the upper ends of front and back walls 10 and 12 to join the lateral edges, respectively, of an offset paraboloidally shaped reflector 18. Extensions 20, 22 and 24 are joined to sides 14, 16 and 10, respectively, at the aperture of the antenna arrangement in such a manner that extensions 20 and 22 are in the same plane as sides 14 and 16, respectively, and extension 24 is perpendicular to front 10 and extends away from the antenna arrangement. The addition of extensions 20, 22 and 24 thereby allowing the antenna arrangement to be capable of supporting a curved paraboloid weather cover 26 in accordance with the present invention. Curved forms 21 and 23 are disposed inside of, and connected to, extensions 20 and 22, respectively, curved forms 21 and 23 providing structural support for weather cover 26 attached thereto.

Weather cover 26, which comprises four edges 28, 30, 32 and 34, may be of any composition suitable to allow the passage of microwave radiation while preventing foreign material from entering the antenna aperture, one such material being glass fiber fabric. In placement, weather cover 26 is disposed in such a manner so that edge 28 of weather cover 26 is attached inside reflector 18, edge 32 is connected to the end of extension 24 furthest from the antenna, and edges 30 and 34 are connected to curved forms 23 and 21 respectively. Edges 30 and 34 are attached to forms 23 and 21 in such a manner so that weather cover 26 is contoured into a cylindrical paraboloidal form, this form capable of focusing the reflections of weather cover 26 onto a line inside the antenna formed by the intersection of back wall 12 and reflector 18.

A rectangular piece of absorbing material 36 is disposed along the intersection of back wall 12 and reflector 18 and is capable of absorbing the focused reflections of weather cover 26, thereby reducing the antenna arrangement sidelobes attributed to weather cover reflections. Absorbing material 36 may be any suitable microwave absorbing material, one example of which is ECCOSORB AN-72, a product of Emerson and Cuming, Inc.

In operation, the antenna is maintained at a positive internal air pressure to assure the weather-proof integrity of the system despite small penetrations of weather cover 26. This positive pressure will cause cylindrical paraboloidal weather cover 26 to bow slightly, producing a doubly-curved surface. The double curve of weather cover 26 reduces the length of the original focal line, and hence, a shorter piece of absorbing material 36 may be employed to absorb the weather cover reflections.

Figure 2:
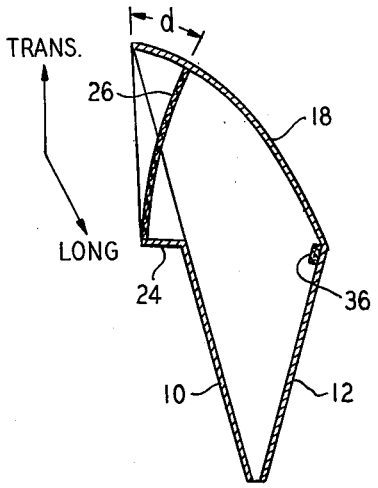
FIG. 2 is a side view in perspective of the horn reflector antenna described hereinabove in association with FIG. 1.

A cut-away sideview of the antenna arrangement discussed hereinabove in association with FIG. 1 is shown in FIG. 2. The top edge 28 of weather cover 26 is displaced a distance d inside reflector 18, where the distance d is chosen so as to create a line focus of weather cover 26 at the junction of back wall 12 and reflector 18.

Figure 3:
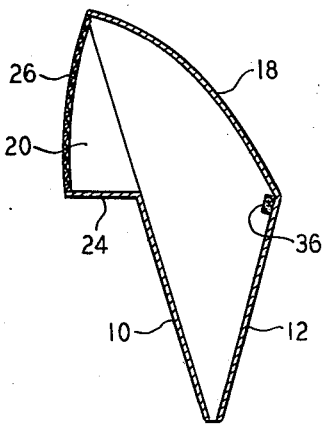
FIG. 3 is a side view in perspective of a horn reflector antenna showing an alternative weather cover placement in accordance with the present invention.

An alternative placement of weather cover 26 in relation to the horn reflector antenna is shown in FIG. 3, which contains a side view in perspective of a rectangular horn reflector antenna. In this case, curved forms 21 and 23 are disposed on the interior edges furthest from reflector 18 of extensions 20 and 22, respectively. Weather cover 26, as attached to reflector 18, forms 21 and 23, and extension 24 is therefore entirely exterior to the antenna aperture. The positioning of the curved forms exterior to the antenna thereby reduces the sidelobes induced by the presence of the forms to a minimum. This weather cover positioning, however, increases the wind load on the antenna system.

Figure 4:
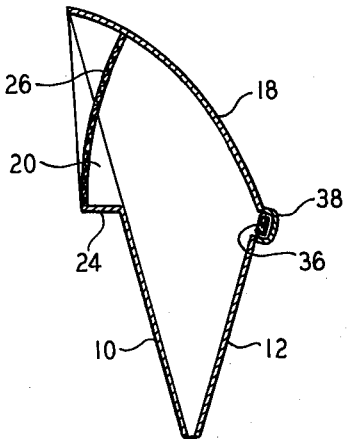
FIG. 4 is a side view in perspective of a horn reflector antenna showing an alternative placement of absorbing material in accordance with the present invention.

Another alternative rectangular horn reflector antenna arrangement as shown in FIG. 4, consists of placing weather cover 26 as in FIG. 2, but opening rear wall 12 where absorbing material 36 is located and placing the absorbing material behind the opening exterior to the antenna arrangement. This placement will allow the absorbing material to absorb the focused weather cover reflections without introducing attenuation into the system due to the presence of the absorbing material. To preserve the pressurization of the antenna, a metallic cover 38 is needed to cover the outside area of the absorbing material.

As used in most microwave radio relay systems, the horn reflector antenna is mounted with the axis of the horn normal to the earth's surface. Hence, the longitudinal and transverse polarization directions, as shown in FIG. 2 and as will be discussed hereinbelow in association with FIGS. 5 and 6, could also be defined as vertical and horizontal polarization directions, respectively. However, the aperture field distributions for each polarization are different, and when the antenna is used as an earth station antenna for satellite communications, or as a radiometer, or simply to obtain radiation patterns in the longitudinal plane, the antenna is mounted on its side, and the aperture field distributions for the vertical and horizontal directions are interchanged. To avoid this ambiguity, only the terms longitudinal and transverse polarizations will be used hereinafter in association with the discussion of FIGS. 5 and 6.

Figure 5:
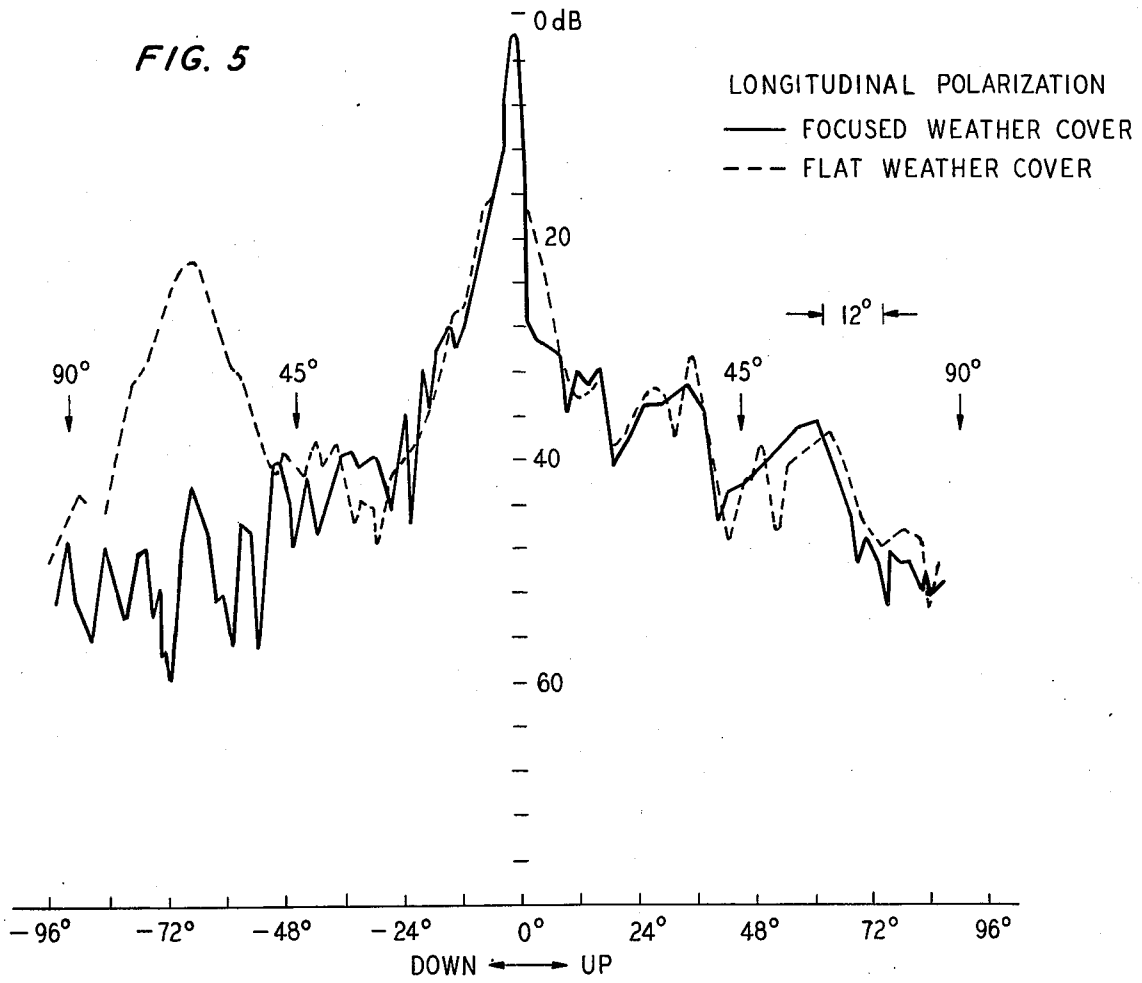
FIG. 5 illustrates the radiation patterns for a longitudinal polarization of the antenna configuration of FIG. 1 where the dashed curve represents the radiation pattern for a horn reflector antenna employing a prior art flat weather cover and the solid curve represents the radiation pattern for a horn reflector antenna formed in accordance with the present invention as shown in FIGS. 1 and 2.
Figure 6:
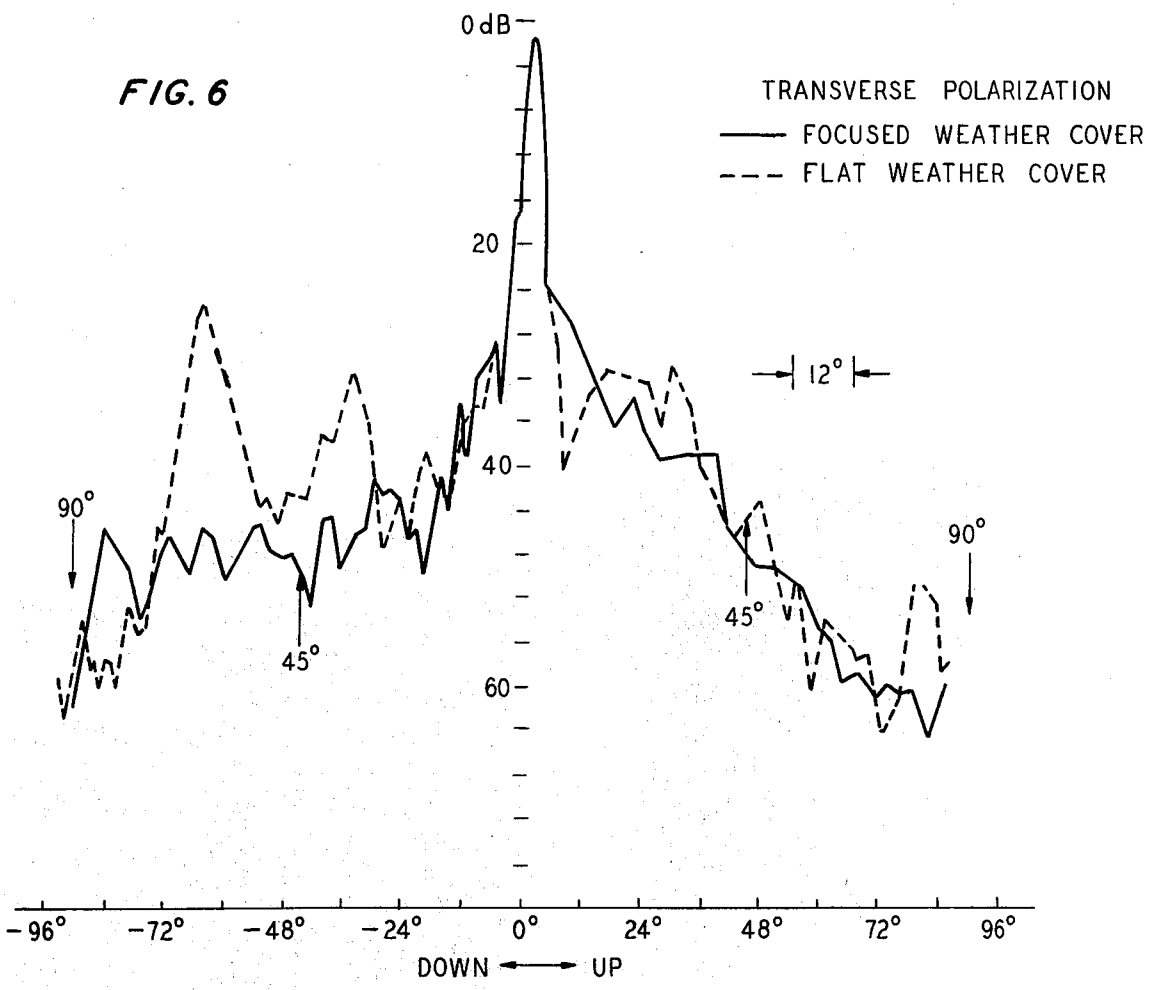
FIG. 6 illustrates the radiation patterns for a transverse polarization of the antenna configuration of FIG. 1 where the dashed curve represents the radiation pattern for a horn reflector antenna employing a prior art flat weather cover and the solid curve represents the radiation pattern for a horn reflector antenna formed in accordance with the present invention as shown in FIGS. 1 and 2.

In order to assess the improvement associated with the present invention, FIGS. 5 and 6 illustrate radiation patterns for both a horn reflector antenna containing a prior art flat weather cover, as represented by a dashed curve, and a horn reflector antenna containing a focusing weather cover and absorbing material, as represented by a solid curve, with FIG. 5 illustrating the comparative longitudinal polarization patterns and FIG. 6 illustrating the comparative transverse polarization patterns.

From the curves shown in FIG. 5, it can be seen that employment of the present invention significantly reduces the longitudinal polarization reflection sidelobe, in this case appearing at approximately −72 degrees, by approximately 20 dB, without causing an appreciable reduction in the gain of the main beam.

A noticeable reduction in the transverse polarization reflection sidelobe is also achieved by implementing the present invention, as can be seen in FIG. 6. In this case, the reflection sidelobe appearing at approximately −48 degrees is reduced by approximately 20 dB, and like the longitudinal polarization case discussed hereinabove in association with FIG. 5, the implementation of the present invention does not result in any appreciable degradation of the main beam.

It should be noted that the radiation patterns illustrated in both FIGS. 5 and 6 were obtained from a scale model of a horn reflector antenna arrangement, and due to the thickness of the weather cover employed with this model, the reflection lobes measured at a frequency of 30 GHz are stronger by approximately 10 dB than the same lobes associated with a full-size antenna, which usually operates at a frequency of approximately 4 GHz. The results obtained from the comparisons discussed hereinabove in association with FIGS. 5 and 6, however, are equally valid for both the scale model and full-size antenna arrangements.

It is to be understood that the above-described embodiments are simply illustrative of the principles of the invention. Various other modifications and changes may be made by those skilled in the art which will embody the principles of the present invention and fall within the spirit and scope thereof.

I claim:

1. A horn reflector antenna comprising an offset main reflector (18) including a reflecting surface and a focal point associated therewith;

absorbing material (36) disposed on the edge of said reflecting surface closest to said focal point;

a feed arrangement (10, 12, 14, 16) disposed at said focal point and in relation to said reflector so as to create an antenna aperture, said feed arrangement capable of transmitting and receiving microwave radiation; and a weather cover (26) disposed at said aperture capable of reflecting a portion of said microwave radiation emanating from said feed arrangement and impinging the surface thereof;

CHARACTERIZED IN THAT the weather cover further comprises a cylindrical paraboloid shape, said weather cover disposed to be capable of focusing the impinging radiation onto the edge of the reflecting surface containing the absorbing material.

2. A horn reflector antenna in accordance with claim 1

CHARACTERIZED IN THAT an edge (28) of the weather cover is positioned at the edge of the reflector furthest from the focal point, such positioning capable of reducing sidelobe levels induced by the presence of said weather cover.

3. A horn reflector antenna in accordance with claim 1

CHARACTERIZED IN THAT an edge (28) of the weather cover is positioned inside of, and in direct contact with, the reflector at a distance (d) from the edge of said reflector furthest the focal point, such positioning capable of reducing windloading problems associated with the use of said weather cover.

4. A horn reflector antenna in accordance with claims 1, 2 or 3

CHARACTERIZED IN THAT the reflector is positioned in such a manner so that the edge of said reflector nearest the focal point is not connected to said antenna, thereby creating a gap in said antenna, with the absorbing material disposed exterior to said antenna and directly behind said gap, such positioning of said reflector and absorbing material thereby eliminating attenuation due to the presence of said absorbing material.

* * * * *